United States Patent [19]

Kusch

[11] Patent Number: 4,872,406

[45] Date of Patent: Oct. 10, 1989

[54] DAMPENING MECHANISM FOR OFFSET ROTARY PRINTING PRESSES

[75] Inventor: Hans-Jürgen Kusch, Neckargemünd, Fed. Rep. of Germany

[73] Assignee: Heidelberger Druckmaschinen Aktiengesellschaft, Heidelberg, Fed. Rep. of Germany

[21] Appl. No.: 247,953

[22] Filed: Sep. 22, 1988

[30] Foreign Application Priority Data

Sep. 22, 1987 [DE] Fed. Rep. of Germany ..... 3731768

[51] Int. Cl.[4] ..... B41F 7/26; B41F 7/40

[52] U.S. Cl. ..... 101/148; 101/352

[58] Field of Search ..... 101/148, 147, 350, 363, 101/207–210, 349, 364, 352

[56] References Cited

U.S. PATENT DOCUMENTS 3,038,405 6/1962 Wojciechowski et al. ..... 101/148
3,343,484 9/1967 Dahlgren ..... 101/148
3,744,414 7/1973 Krochert et al. ..... 101/148
4,351,236 9/1982 Beisel et al. ..... 101/148

FOREIGN PATENT DOCUMENTS 1561113 2/1970 Fed. Rep. of Germany .
2054678 5/1975 Fed. Rep. of Germany .

*Primary Examiner*—J. Reed Fisher
*Attorney, Agent, or Firm*—Nils H. Ljungman

[57] ABSTRACT

This invention relates to a dampening mechanism for offset rotary printing presses with a supply roller partly immersed in the dampening fluid. Downstream rollers transfer the dampening fluid to the printing plate. At least one of two or more elastic metering rollers selectively interacts with the supply roller for the exact metering of the amount of dampening fluid required, even at different press speeds, two or more metering rollers with different degrees of hardness are used.

18 Claims, 3 Drawing Sheets

DAMPENING MECHANISM FOR OFFSET ROTARY PRINTING PRESSES

BACKGROUND OF THE INVENTION

1. Field of the Invention

This invention relates to a dampening mechanism for offset rotary printing presses with a supply roller partly immersed in the dampening fluid, with downstream rollers transferring the dampening fluid to the printing plate, and with an elastic metering means which cooperates with the supply roller.

One type of dampening mechanism is described in German Patent No. 20 54 678 and a corresponding U.S. Pat. No. 3,744,414, in which there is a supply roller with a metering roller to meter the quantity of dampening fluid to be transferred to the printing plate. Such metering rollers are provided with an elastic jacket surface and are placed in contact with the supply roller by means of adjustable cams to squeeze off and thereby reduce the amount of dampening fluid thereon.

These characteristics have been controlled on metering rollers of the prior art, as far as possible, by means of separate, adjustable or variable drives to guarantee an even supply of dampening fluid, even at different printing speeds. However, the apparatus required for the controls, drives and circuitry significantly increases the cost of the dampening mechanism.

German Patent No. 15 61 113 includes a dampening mechanism which appears to employ a feed or supply roller for the introduction of dampening fluid to the printing plate thereof. A first squeeze or metering roller basically removes excess dampening fluid from the feed or supply roller. However, an additional pair of squeeze rollers are located at the ends of the feed or supply roller for alternative removal of additional dampening fluid when relatively narrow paper is employed. The two squeeze or metering rollers at the ends of the supply roller are therefore capable of removing dampening fluid which might accumulate on the inking rollers if not properly removed during the printing process. There is even disclosure of the alternative use of blower apparatus in this region to ensure adequate removal of dampening fluid at the edges of the supply roller.

German Patent Nos. 15 61 113 and 20 54 673 and U.S. Pat. No. 3,744,414 are incorporated by reference as if included in their entirety herein.

OBJECTS OF THE INVENTION

The object of this invention is to ensure a precise metering of the required amount of dampening fluid at different printing press speeds.

Another object of the invention includes adjusting the amount of dampening fluid to compensate for different operating temperatures of the printing press.

SUMMARY OF THE INVENTION

In general, the invention features a dampening mechanism for a rotary printing press including a printing plate comprising: a rotatable supply roller having a cylindrical surface; the supply roller being for rotation at a speed relative to a printing speed of the printing press; an arrangement for applying dampening fluid to the cylindrical surface during rotation of the supply roller; an arrangement for transferring at least some of the dampening fluid on the cylindrical surface to the printing plate; a first metering roller having an outer surface with a predetermined first surface characteristic; a second metering roller having an outer surface with a predetermined second surface characteristic; an arrangement for selectively causing at least one of the outer surface of the first metering roller and the outer surface of the second metering roller to be in contact with the cylindrical surface downstream of the arrangement for applying the dampening fluid and upstream of the arrangement for transferring; the outer surface of the first metering roller being in contact with the cylindrical surface for causing a first range of quantities of the dampening fluid to be on the cylindrical surface for transfer to the printing plate by the arrangement for transferring during a first set of operating conditions of the printing press; and the outer surface of the second metering roller being in contact with the cylindrical surface for causing a second range of quantities of the dampening fluid to be on the cylindrical surface for transfer to the printing plate by the arrangement for transferring during a second set of operating conditions of the printing press.

The invention features, in another embodiment, a dampening mechanism for a rotary printing press including a printing plate comprising: a rotatable supply roller having a cylindrical surface; an arrangement for applying dampening fluid to the cylindrical surface during rotation of the supply roller; an arrangement for transferring at least some of the dampening fluid on the cylindrical surface to the printing plate; a plurality of metering rollers respectively having outer surfaces with different surface hardnesses: an arrangement for selectively causing the outer surface of at least one of the plurality of the metering rollers to be in contact with the cylindrical surface downstream of the arrangement for applying the dampening fluid and upstream of the arrangement for transferring; and each of the plurality of the metering rollers with its respective the surface hardness being capable of removing a corresponding by different quantity of the dampening fluid from the cylindrical surface prior to transfer to the printing plate by the arrangement for transferring.

Generally, the objects are achieved by the invention, in that the metering is provided by two or more metering rollers with elastic jacket surfaces, whose jacket surfaces have different degrees of hardness. The metering rollers can be alternately placed in contact with the supply roller, so that when the speed increases, the metering rollers with a higher degree of hardness are placed in contact with the supply roller. By means of this solution, when two or three metering rollers are used, at low speeds, a metering roller with a relatively soft jacket surface can be placed in contact with the supply roller. When the printing press speed increases, a metering roller with a higher degree of hardness can be placed in contact with the supply roller. Even at higher hydrodynamic pressure, the amount of dampening fluid on the supply roller can be reduced to the extent necessary for the printing operation at hand.

There are also included advantageous configurations of the invention in which apparatus is provided to make possible a continuous transition of the squeezing from the hard to the soft metering roller and vice-versa, or, if necessary, also a step-wise change of the metering rollers. Because of the adjustment cams provided, the position of the individual metering rollers can be set very precisely. When an electric motor or servomotor is used to activate the adjustment cam or cams, the control of the electric motor or servomotor can be derived from the speed control of the press.

Additional adjustments to the electric motor or servomotor can be made to compensate for the temperature of the printing press within a range of normal operating temperatures.

One embodiment of the invention is schematically illustrated in the drawings.

DESCRIPTION OF THE PREFERRED EMBODIMENTS

Figure 1:
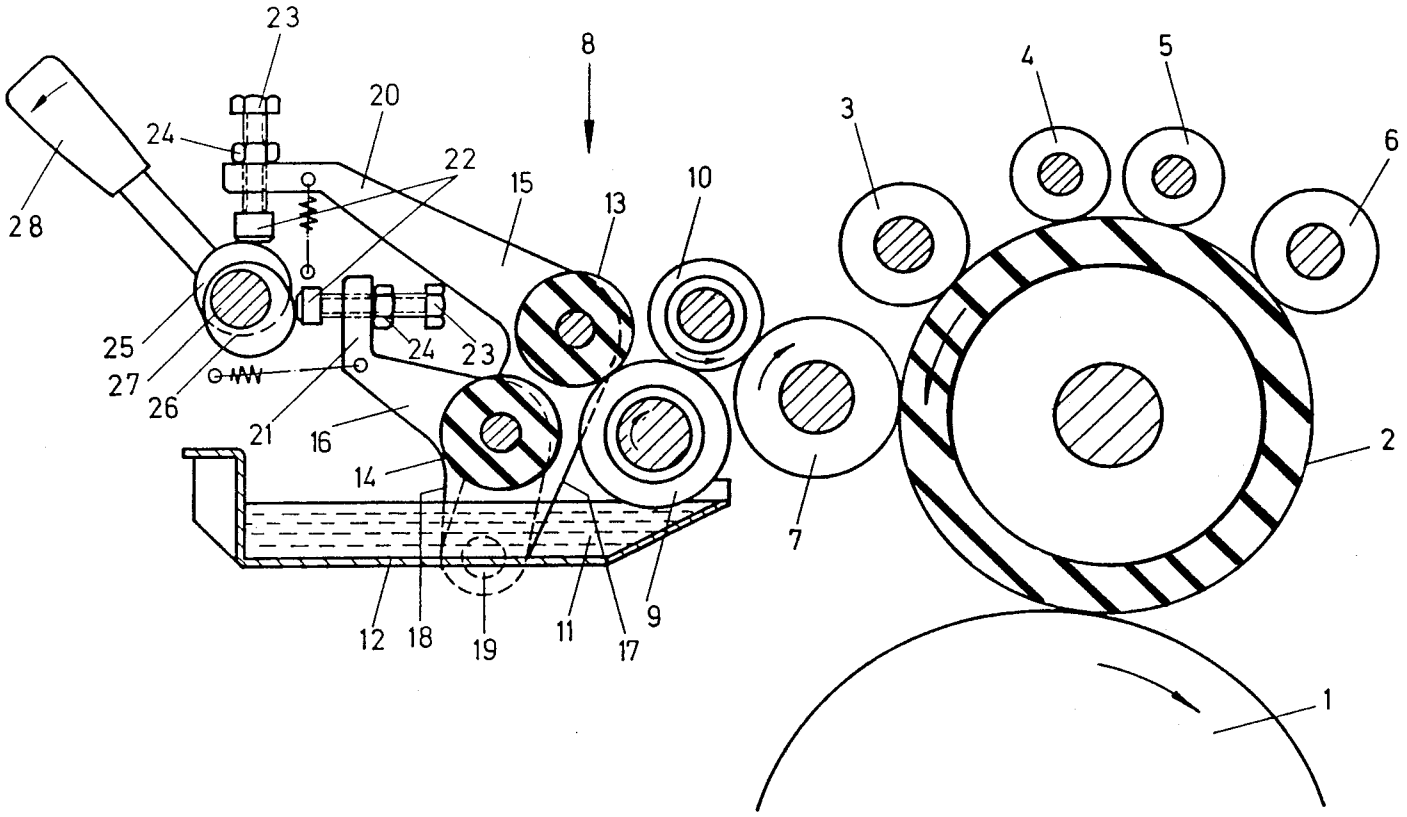
FIG. 1 shows a dampening mechanism including various features of the invention with a hard metering roller in contact with the supply roller for high machine speeds.
Figure 2:
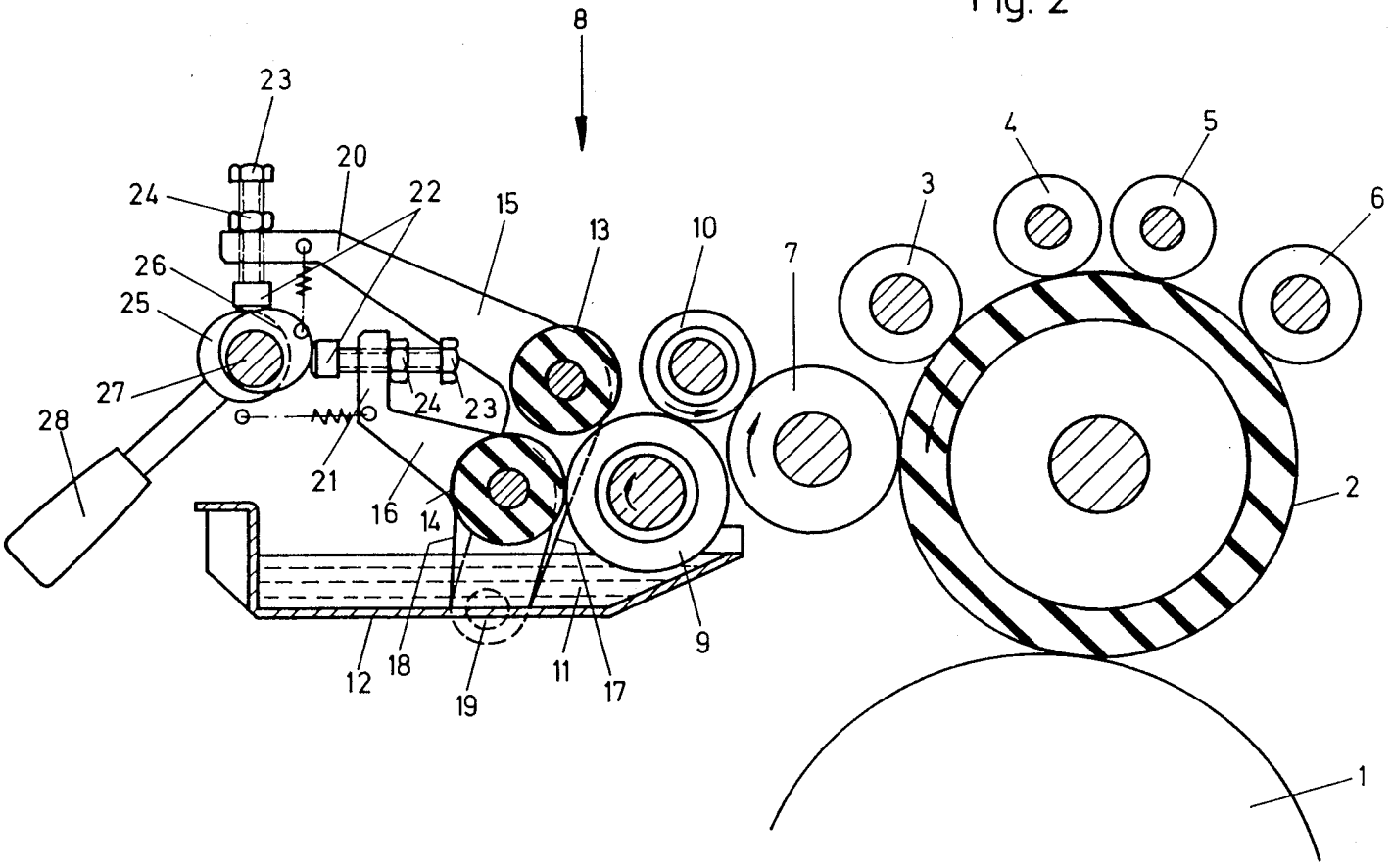
FIG. 2 shows a dampening mechanism of the invention with a soft metering roller in contact with the supply roller for low machine speeds.
Figure 3:
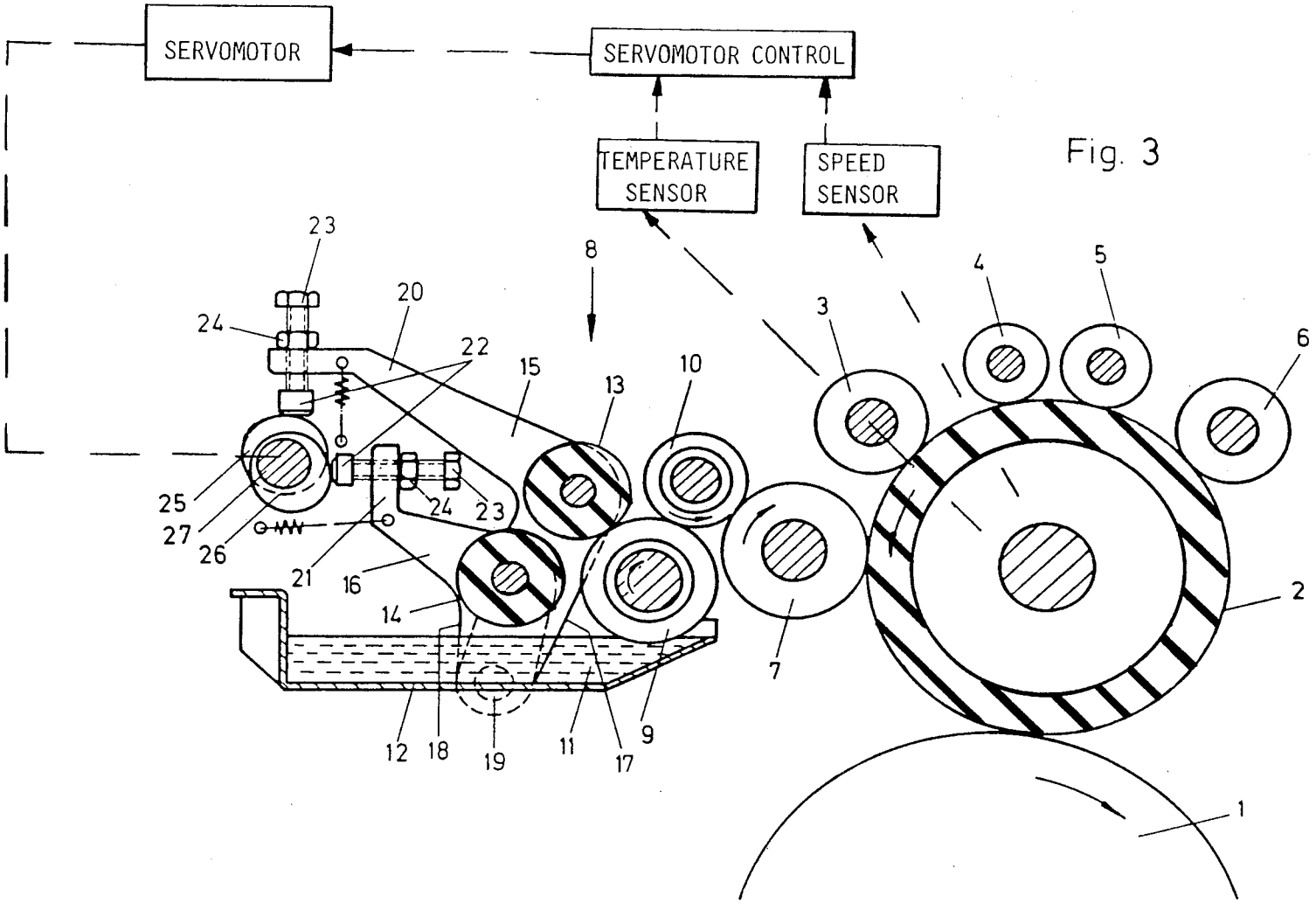
FIG. 3 shows the dampening mechanism of FIGS. 1 and 2 including additional features of the invention.

As seen in FIGS. 1, 2 and 3, a plate cylinder 1 is used in conjunction with an inking roller 2 which has an elastic jacket surface. The inking roller 2 is, in turn, in contact with four rollers 3, 4, 5 and 6 of an inking mechanism (not shown). Furthermore, the inking roller 2 is in contact with a roller 7 of the dampening mechanism 8, which is supplied by a supply roller 9 and an intermediate roller 10. The supply roller 9 is partly immersed in the dampening fluid 11 in a fluid container 12.

In alignment with the supply roller 9 are two metering rollers 13 and 14, each of which has an elastic jacket surface. In the preferred embodiment, the metering roller 13 has a rubber jacket surface which has a hardness of about 50 to about 60 degrees Shore. The metering roller 14 has a softer rubber jacket surface with a hardness of about 30 to about 40 degrees Shore. Each metering roller 13, 14 is respectively mounted at both ends in an angle lever 15, 16, which is pivotally mounted so that it can pivot with a lever arm 17, 18 on a bolt 19. The pivot bolt 19 is mounted to the printing press side frame. It is thereby possible to place either the metering roller 13 or the metering roller 14 in contact with the supply roller 9.

To place the two metering rollers 13, 14 in contact with the supply roller 9, the angle levers 15, 16 respectively include lever arms 20, 21, to which adjustable stops 22 are fastened. The stops 22 can be adjusted, for example, by means of set screws 23 and locked in place by means of lock nuts 24. The stops 22 thereby make contact with adjustment cams 25, 26, which are mounted on a shaft 27. Biasing, in the form of springs, is provided to the angle levers 15, 16 to maintain the stops 22 in contact with the cams 25, 26 throughout operation of the printing press. The cam 25 in the preferred embodiment corresponds to the metering roller 13 and the cam 26 corresponds to the metering roller 14. The shaft 27 can be rotated or pivoted through, for example, about 90 degrees by means of a metering lever 28 fastened thereon. As a result; the metering roller 13 or the metering roller 14 can be alternatively placed in contact with the supply roller 9. The cams can be designed to provide a transition phase during which the pressure on one metering roller is released and the pressure on the other is brought into contact. By means of the metering lever 28 and the cams 25, 26, the contact pressure of the individual metering rollers 13, 14 against the supply roller 9 can be infinitely varied or adjusted.

In one alternative embodiment, an actuator or servomotor, as seen in FIG. 3, can be located on the shaft 27 with the adjusting cams 25 and 26. At low printing speeds, the actuator or servomotor can move the metering roller 14 with a soft rubber jacket surface into contact with the supply roller 9. At higher printing speeds, it can move the metering roller 13 with a hard rubber jacket surface into contact with the supply roller 9. The control circuit of such a servomotor can be controlled in two or more speed ranges of the printing press by the printing press control itself. The control within two or more speed ranges for the servomotor would not be limited to simply positioning either the metering roller 13 or the metering roller 14 into contact with the supply roller 9. The control would also include varying the position of the shaft 27 and thus the adjusting cam 25 or 26 according to the actual speed of the printing press within the speed ranges. In other words, the higher the speed within a particular range, the servomotor would be positioned to produce a higher pressure on the metering roller 13 or metering roller 14.

As mentioned above, additional adjustment to the positioning of the shaft 27 is appropriate depending on the operating temperature of the printing press within a normal range of operating temperatures. Accordingly, further adjustment in the controls can be added to make minor adjustments to the servomotor and thus the position of the shaft 27 depending upon the particular operating temperature existing. For example, if the temperature is relatively high, the servomotor and thus the shaft 27 might be slightly actuated to adjust the appropriate adjusting cam 25 or 26 to slightly decrease the contact pressure of the metering roller 13 or metering roller 14 in order to remove less dampening fluid from the supply roller 9. The allowance of more dampening fluid on the supply roller 9 would compensate for the higher viscosity of the dampening fluid and the higher rate of evaporation of the dampening fluid as it is being transferred to the printing plate.

Accordingly, the control as shown in FIG. 3 would include sensing information regarding the operating speed of the printing press and regarding the operating temperature of the printing press. Such sensing is well known in the printing press art.

With a dampening mechanism designed in such a manner, with different hydrodynamic forces of the dampening fluid corresponding to the particular printing press speed, the metering rollers can therefore be used which are capable of performing an exact metering of the amount of dampening fluid while avoiding excessive roller pressure. Further, with additional information regarding the operating temperature of the printing press, minor adjustments to the contact pressure can be made to compensate for evaporation of and the viscosity of the dampening fluid.

The dampening mechanism is for offset rotary printing presses with a supply roller 9 partly immersed in the dampening fluid 11, with downstream rollers 2, 7, 10 to transfer the dampening fluid to the printing plate, and with an elastic metering means interacting with the supply roller 9. The dampening mechanism is characterized by the fact that the metering means are two or more metering rollers 13, 14 with elastic jacket surfaces. The jacket surfaces exhibit different degrees of hardness. Consequently, the metering rollers 13, 14 can be alternately placed against the supply roller 9, so that when the press speed increases, metering rollers with a higher degree of hardness are placed in contact with the supply roller.

The dampening mechanism is also characterized by the fact that the metering rollers 13, 14 have rubber jacket surfaces with hardnesses between about 30 and about 60 degrees Shore.

The dampening mechanism is further characterized by the fact that there are two metering rollers 13, 14, one 14 of which is designed with a soft rubber jacket surface with a hardness of about 30 to about 40 degrees Shore, and the second 13 of which is designed with a hard rubber jacket surface with a hardness of about 50 to about 60 degrees Shore. Each metering roller 13, 14 is mounted on both ends in an angle lever 15, 16, which is mounted on the press side frame on bolts 19 so that it can pivot. The lever 15, 16 is supported by means of adjustable stops 22 on cams 25, 26, which are fastened to a shaft 27 which can be pivoted by means of a metering lever 28.

The dampening mechanism is still further characterized by the fact that corresponding to the shaft 27 with the cams 25, 26 there is a servomotor. At low press speed the servomotor presses down the metering roller 14 with the soft jacket surface, and at high machine speed presses down the metering roller 13 with a hard jacket surface to make contact with the supply roller.

Some examples of control systems and sensors are U.S. Pat. No. 3,983,930 entitled "Temperature Control System and Multifunctional Servomotor Therefor", U.S. Pat. No. 4,502,853 entitled "Rotational Speed Sensor for Vane Compressors" and U.S. Pat. No. 4,206,732 entitled "Air Cleaner Temperature Sensor". These patents are incorporated by reference as if included in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A dampening mechanism for a rotary printing press including a printing plate comprising:

a rotatable supply roller having a cylindrical surface;

said supply roller rotatable at a speed relative to a printing speed of said printing press;

means for applying dampening fluid to said cylindrical surface during rotation of said supply roller;

means for transferring at least some of said dampening fluid on said cylindrical surface to said printing plate;

a first metering roller having an outer surface with a predetermined first surface characteristic;

a second metering roller having an outer surface with a predetermined second surface characteristic;

means for selectively and alternately causing at least one of said outer surface of said first metering roller and said outer surface of said second metering roller to be in contact with said cylindrical surface downstream of said means for applying said dampening fluid and upstream of said means for transferring;

said means for causing allowing only one of said metering rollers to be in contact with said cylindrical surface at a time.

said outer surface of said first metering roller being in contact with said cylindrical surface for causing a first range of quantities of said dampening fluid to be on said cylindrical surface for transfer to said printing plate by said means for transferring during a first set of operating conditions of said printing press; and said outer surface of said second metering roller being in contact with said cylindrical surface for causing a second range of quantities of said dampening fluid to be on said cylindrical surface for transfer to said printing plate by said means for transferring during a second set of operating conditions of said printing press.

2. The dampening mechanism according to claim 1, wherein said predetermined first surface characteristic includes a predetermined first surface hardness, said predetermined second surface characteristic includes a predetermined second surface hardness, and said predetermined first surface hardness is at a higher degree of hardness than said predetermined second surface hardness.

3. The dampening mechanism according to claim 2, wherein said predetermined first surface hardness is about 50 to about 60 degrees Shore and said predetermined second surface hardness is about 30 to about 40 degrees Shore.

4. The dampening mechanism according to claim 2, wherein said first range of quantities of said dampening fluid includes lesser quantities of said dampening fluid than does said second range of quantities of said dampening fluid.

5. The dampening mechanism according to claim 4, further including first means for varying a pressure of said contact between said outer surface of said first metering roller and said cylindrical surface to inversely vary said quantities of said dampening fluid within said first range and second means for varying a pressure of said contact between said outer surface of said second metering roller and said cylindrical surface to inversely vary said quantities of said dampening fluid within said second range.

6. The dampening mechanism according to claim 4, wherein said first set of operating conditions includes a first range of printing speeds, said second set of operating conditions includes a second range of printing speeds, and said first range of said printing speeds includes higher said printing speeds than does said second range of said printing speeds.

7. The dampening mechanism according to claim 6, further including first means for varying a pressure of said contact between said outer surface of said first metering roller and said cylindrical surface to inversely vary said quantities of said dampening fluid within said first range and second means for varying a pressure of said contact between said outer surface of said second metering roller and said cylindrical surface to inversely vary said quantities of said dampening fluid within said second range.

8. The dampening mechanism according to claim 7, wherein said quantities of said dampening fluid within said first range vary inversely with the printing speeds within said first range of the printing speeds and said quantities of said dampening fluid within said second range vary inversely with said printing speeds within said second range of the printing speeds.

9. The dampening mechanism according to claim 8, wherein said means for selectively causing at least one of said outer surface of said first metering roller and said outer surface of said second metering roller to be in contact with said cylindrical surface includes said first means for varying a pressure of said contact between said outer surface of said first metering roller and said cylindrical surface and said second means for varying a pressure of said contact between said outer surface of said second metering roller and said cylindrical surface.

10. The dampening mechanism according to claim 7, wherein said first set of operating conditions and said second set of operating conditions include said printing press operating within a temperature range of operating temperatures, further including means for adjusting said first means for varying a pressure and said second means for varying a pressure to adjust said pressure in relationship to said operating temperature within said temperature range.

11. The dampening mechanism according to claim 10, wherein said means for adjusting includes said pressure inversely varying relative to said operating temperature within said temperature range.

12. A dampening mechanism for a rotary printing press including a printing plate comprising:

a rotatable supply roller having a cylindrical surface;

means for applying dampening fluid to said cylindrical surface during rotation of said supply roller;

means for transferring at least some of said dampening fluid on said cylindrical surface to said printing plate;

a plurality of metering rollers respectively having outer surfaces with different surface hardnesses;

means for selectively and alternately causing said outer surface of at least one of said plurality of said metering rollers to be in contact with said cylindrical surface downstream: of said means for applying said dampening fluid and upstream of said means for transferring;

said means for causing allowing only one of said metering rollers to be in contact with said cylindrical surface at a time; and each of said plurality of said metering rollers with its respective said surface hardness being capable of removing a corresponding but different quantity of said dampening fluid from said cylindrical surface prior to transfer to said printing plate means for transferring.

13. The dampening mechanism according to claim 12, wherein said outer surfaces of said plurality of said metering rollers includes elastic jacket surfaces having hardnesses between about 30 and about 60 degrees Shore.

14. The dampening mechanism according to claim 13, wherein a first of said metering rollers includes said outer surface thereof having a surface hardness of about 30 to about 40 degrees Shore and a second of said metering rollers including said outer surface thereof having a surface hardness of about 50 to about 60 degrees Shore.

15. The dampening mechanism according to claim 13, wherein each of said metering rollers is mounted at opposite ends thereof on an angle lever which is pivotally mounted to frame means of said printing press, said angle lever includes an extension thereof in alignment with rotatable cam means, and said means for selectively causing said outer surface of at least one of said plurality of said metering rollers includes selective rotation of said cam means.

16. The dampening mechanism according to claim 15, wherein said selective rotation of said cam means is produced by a servomotor, further including means for controlling said servomotor for positioning thereof in correspondence with a printing speed of said printing press.

17. The dampening mechanism according to claim 16, further including means for adjusting a position of said servomotor in relationship to an operating temperature of said printing press.

18. The dampening mechanism according to claim 17, wherein said servomotor is positioned at relatively low printing press speeds to cause said cam means to direct a first of said metering rollers with a relatively soft surface hardness and to position said servomotor at relatively high printing press speeds to direct another of said metering rollers with a relatively hard surface hardness into respective contact with said supply roller.

* * * * *